United States Patent [19]

Hasegawa et al.

[11] 4,042,469

[45] Aug. 16, 1977

[54] PROCESS FOR ELECTROLYTICALLY COLORING ALUMINUM AND ALUMINUM ALLOYS IN GOLD

[75] Inventors: Mutsuo Hasegawa, Uozu; Toshikazu Imaoka, Kurobe; Kazuo Aikawa, Toyama, all of Japan

[73] Assignee: Yoshida Kogyo Kabushiki Kaisha, Tokyo, Japan

[21] Appl. No.: 663,625

[22] Filed: Mar. 3, 1976

[30] Foreign Application Priority Data

Mar. 5, 1975 Japan ..... 50-26066

[51] Int. Cl.[2] ..... C25D 11/22

[52] U.S. Cl. ..... 204/42; 204/35 N; 204/58

[58] Field of Search ..... 204/35 N, 58, 56 R, 204/42; 427/419 A

[56] References Cited

U.S. PATENT DOCUMENTS 3,795,590 3/1974 Patrie ..... 204/35 N

FOREIGN PATENT DOCUMENTS 20,568 6/1971 Japan ..... 204/35 N 37,823 9/1972 Japan ..... 204/35 N

*Primary Examiner*—G. L. Kaplan

*Attorney, Agent, or Firm*—Hill, Gross, Simpson, Van Santen, Steadman, Chiara & Simpson

[57] ABSTRACT

Aluminum or aluminum alloy is first anodized to form an oxide film thereon. The anodized basis metal is electrolyzed by use of alternating current in an electrolytic solution which is prepared by adding formaldehyde, usually as formalin, and a thiosulfate to an acid solution of stannous sulfate. The acid solution of stannous sulfate can be prepared by dissolving stannous sulfate in an aqueous solution of sulfuric acid, sulfamic acid, tartaric acid or the like.

5 Claims, No Drawings

PROCESS FOR ELECTROLYTICALLY COLORING ALUMINUM AND ALUMINUM ALLOYS IN GOLD

BACKGROUND OF THE INVENTION a. Field of the Invention

This invention relates to a process for electrolytically coloring aluminum or any of its various alloys a gold color.

b. Prior Art

A variety of processes have been developed for coloring aluminum and aluminum alloys. Typical examples of such known processes include one wherein an oxide film formed anodically on a basis metal is dipped in a solution of an organic dye or inorganic compound; another wherein aluminum alloy is colored by its own composition or by bath composition; and still another wherein an anodized basis metal is electrolyzed by use of alternating current in a bath containing a metallic salt, with the consequent deposition of the metal or metal oxide on the oxide film on the basis metal.

The first described dip coloring process has drawbacks such as the low weather resistance of the color produced and the irregularity of coloring due to fluctuations in bath temperature or in film thickness. The second described process, in which workpieces become colored simultaneously as coatings are formed thereon by electrolysis, has difficulties in connection with production of homogeneous alloy. Additional problems include the irregularity of coloring due to uneven coatings produced, the need for the use of high voltages, and high expenses required.

Most widely practiced has been the third process mentioned above, wherein anodized workpieces have their oxide films colored by electrolysis in a metallic salt bath with the use of alternating current. For coloring aluminum or aluminum alloy in gold, the principles of this third process have been utilized in several proposed methods. Since the metallic salts used by these prior art methods are either expensive or noxious, such methods are disadvantageous from the standpoints of production, bath control, and pollution. Another disadvantage is that the gold colored coatings produced by these methods are often poor in weather resistance.

It has also been suggested to use a bath of tin salt or of its aqueous solution in electrolytically coloring anodized aluminum or aluminum alloy by use of alternating current. According to this known process, however, the basis metal can only be colored light beige, olive, bronze, deep red, black and so forth, but not gold, no matter how the concentration of the metallic salt and other conditions of electrolysis are controlled.

SUMMARY OF THE INVENTION

It is the primary object of this invention to provide an improved process for electrolytically coloring aluminum and aluminum alloys a gold color, such that the listed disadvantages of the prior art are thoroughly overcome.

Another object of the invention is to provide a process of the character described whereby aluminum or aluminum alloy can be colored uniformly and speedily to a desired degree.

A further object of the invention is to provide a process of the character described such that gold colored coatings formed on aluminum or aluminum alloy have excellent weather resistance, among other improved properties.

Briefly, the process according to this invention comprises the steps of anodizing aluminum or aluminum alloy, and electrolyzing the anodized basis metal by use of alternating current in an electrolytic solution which has been prepared by adding formaldehyde and a thiosulfate to an acid solution of stannous sulfate.

The electrolytic solution proposed hereby provides gold colored coatings of excellent weather resistance and other properties. Moreover, aluminum or aluminum alloy can be uniformly colored a desired shade of gold regardless of the amount of workpieces put to simultaneous treatment, or in spite of the possible unevenness of the oxide films thereon or the simultaneous racking of workpieces of various shapes and sizes.

The above and other objects, features and advantages of this invention will become more clearly apparent from the following detailed description, examples and claims.

DETAILED DESCRIPTION OF THE INVENTION

Aluminum and aluminum alloys to be colored gold by the process of this invention comprise pure aluminum and the alloys of pure aluminum and at least one of any such element as silicon, manganese, copper, nickel, zinc, chromium, lead, bismuth, iron, titanium, and magnesium.

For anodizing aluminum or any of such aluminum alloys, a desired basis metal may first be degreased, rinsed and otherwise suitably pretreated, as has been known heretofore. The pretreated basis metal is made anodic in the usual acid electrolytic solution containing sulfuric acid, oxalic acid, sulfamic acid or the like, and electric current is passed through the solution between the anodic basis metal and a cathode also immersed therein as the counter electrode.

According to the novel concepts of this invention, aluminum or aluminum alloy which has been anodized as described above is then electrolyzed by use of alternating current in an electrolytic solution which has been prepared by adding formaldehyde and a thiosulfate to an acid solution of stannous sulfate.

The electrolytic solution according to the invention can be prepared by first dissolving stannous sulfate in a suitable acid solution and then by adding formaldehyde and a thiosulfate thereto. As the acid solution there can be employed, for example, aqueous solutions of such substances as sulfuric acid, phosphoric acid, sulfamic acid, tartaric acid, lactic acid, acetic acid, propionic acid, and sulfosalicylic acid. The concentration of stannous sulfate in the solution should be not less than about 1.5 grams per liter and, for the best results, in the range of from about 3 to 30 grams per liter in view of the cost and other practical factors.

A thiosulfate to be added to the acid solution of stannous sulfate can be ammonium thiosulfate, sodium thiosulfate, potassium thiosulfate, iron thiosulfate or the like. Its concentration in the electrolytic solution should range from about 0.3 to 10 grams per liter and, for the best results, from about 0.5 to 3 grams per liter. The thiosulfate performs some vital functions in the electrolytic solution according to the invention: first, it colors tin contained in the solution a gold color and, second, it speeds the coloring of workpieces.

In addtion to formaldehyde itself, there can be used any such substance as formalin, trioxane or paraformaldehyde which forms formaldehyde in the solution. The concentration of formaldehyde in the electrolytic solution should range from about 3 to 50 grams per liter and, for the best results, from about 7 to 25 grams per liter. Formaldehyde in the electrolytic solution serves as a stabilizer; without it, precipitation would take place upon addition of a thiosulfate to the acid solution of stannous sulfate. The pH of the electrolytic solution should be up to about 3 and, for the best results, up to about 1.5.

The pores in the films which have been colored electrolytically by the above described process of this invention may be sealed by boiling water, by chemicals, by live steam, or by any such conventional means. After, or without, the sealing treatment, the colored surfaces may be coated with a suitable resin paint as by the dipping or electrodeposition method for protection purposes.

The inventive process is hereinafter described more specifically in terms of several Inventive Examples, which, however, are meant purely to illustrate or explain and not to impose limitations on the invention. Also given hereinbelow are some Comparative Examples which are intended to make clear the advantages of the inventive process over the prior art.

INVENTIVE EXAMPLE I

For anodic treatment, a specimen consisting of an aluminum extrusion sized 150 millimeters by 70 by 1.3 was degreased, etched and desmutted in the usual manner. The thus pretreated specimen was made anodic in an aqueous solution of 17.5 W/V % sulfuric acid, and a DC voltage of 15 volts was impressed for 35 minutes across the anodic specimen and an aluminum cathode connected as the counter electrode in the bath. The current density was 1.2 amperes per square decimeter. An anodic oxide film with a thickness of about 12 microns was thus produced on the specimen, which was then rinsed.

The electrolytic coloring of the above anodized specimen was conducted in a vessel with a length of 300 millimeters, a width of 100 millimeters and a height of 150 millimeters. This vessel was filled with an electrolytic solution of the following composition according to the invention:

| | | |
|---|---|---|
| Stannous sulfate | 8 | g/l |
| Sulfamic acid | 30 | g/l |
| Tartaric acid | 10 | g/l |
| Sodium thiosulfate | 1.5 | g/l |
| Formalin (37% aqueous solution) | 25 | g/l |

The pH of the above electrolytic solution was 1.0, and its temperature was 20° C. The anodized specimen was immersed in the solution, together with a single counter electrode which was placed at a distance of 250 millimeters from the specimen. The specimen was then electroylzed for six minutes by use of alternating current at a potential of 18 volts. The surfaces of the specimen were uniformly colored gold regardless of their positions with respect to the counter electrode.

The above obtained gold-colored film on the specimen was then subjected to sealing treatment for 30 minutes by live steam, under pressure of five kilograms per square centimeter. A 3000-hour accelerated weathering test of the finished specimen by means of a weatherometer developed no change in its colored surfaces. Also, no change in color took place when the specimen was heated to a temperature of 200° C for two hours, and the specimen remained intact when subjected to a 16-hour CASS (salt spray) test. It has thus been confirmed that aluminum or aluminum alloy colored gold by the process of this invention will sufficiently withstand outdoor use.

INVENTIVE EXAMPLE II

An aluminum extrusion sized 150 millimeters by 70 by 1.3 was anodized by use of the procedure set forth in Inventive Example I to form thereon an oxide film with a thickness of about 12 microns. The anodized specimen was rinsed and then electrolyzed for three minutes by use of alternating current at a potential of 12 volts in an electrolytic solution of the following composition:

| | | |
|---|---|---|
| Stannous sulfate | 4 | g/l |
| Sulfuric acid | 40 | g/l |
| Ammonium thiosulfate | 1.0 | g/l |
| Formalin (37% aqueous solution) | 40 | g/l |

The temperature of this electrolytic solution was 20° C. The specimen was uniformly colored deep gold.

The pores in the thus obtained gold-colored film on the specimen were sealed in the same manner as in Inventive Example I. The finished specimen exhibited the same favorable results as that of Inventive Example I when subjected to a 3000-hour accelerated weathering test by means of a weatherometer, a 2-hour heating test at a temperature of 200° C, and a CASS test.

COMPARATIVE EXAMPLE I

An aluminum extrusion sized 150 millimeters by 70 by 1.3 was anodized by use of the procedure of Inventive Example I to form thereon an oxide film about 12 microns thick. The anodized specimen was rinsed and then electrolyzed for three minutes by use of alternating current at a potential of 12.5 volts in an electrolytic solution of the following composition, which had a temperature of 20° C:

| | |
|---|---|
| Stannous sulfate | 6 g/l |
| Sulfuric acid | 40 g/l |

The specimen was colored light yellowish brown. Its surface which had been directed away from the counter electrode, moreover, was colored a slightly lighter shade than the other surface which had been facing the counter electrode.

COMPARATIVE EXAMPLE II

To the electrolytic solution of Comparative Example I was added 1.0 gram per liter of ammmonium thiosulfate to prepare a solution of the following composition:

| | |
|---|---|
| Stannous sulfate | 6 g/l |
| Sulfuric acid | 40 g/l |
| Ammonium thiosulfate | 1 g/l |

Precipitation took place immediately upon addition of ammonium thiosulfate to the solution of Comparative Example I.

An aluminum extrusion sized 150 millimeters by 70 by 1.3 which had been anodized and rinsed by use of the procedure described in Comparative Example I was electrolyzed for three minutes by use of alternating current at a potential of 12.5 volts in the electrolytic solution of the above composition which had a temperature of 20° C and in which precipitation was taking place as mentioned above. Although the specimen was initially uniformly colored gold, eventually its coloring assumed the undesired results set forth in Comparative Example I.

INVENTIVE EXAMPLE III

To the electrolytic solution of Comparative Example I were added, in accordance with the teaching of this invention, 40 grams per liter of formalin (37% aqueous solution) and, thereafter, 1.0 gram per liter of ammonium thiosulfate to prepare a solution of the following composition:

| | |
|---|---|
| Stannous sulfate | 6 g/l |
| Sulfuric acid | 40 g/l |
| Ammonium thiosulfate | 1 g/l |
| Formalin (37% aqueous solution) | 40 g/l |

By use of the procedure set forth in Comparative Example I an aluminum extrusion of the same size as described above was anodized and rinsed. The anodized specimen was then electrolyzed for three minutes in the electrolytic solution of the above composition, which had a temperature of 20° C, by use of alternating current at a potential of 12.5 volts. The specimen was uniformly colored deep gold on both of its surfaces.

COMPARATIVE EXAMPLE III

An aluminum extrusion of the same size as described above was anodized by use of the procedure of Inventive Example I to form thereon on oxide film about 12 microns thick. The anodized specimen was rinsed and then electrolyzed for three minutes by use of alternating current at a potential of 15 volts in an electrolytic solution of the following composition, which had a temperature of 20° C:

| | |
|---|---|
| Stannous sulfate | 5 g/l |
| Sulfuric acid | 5 g/l |
| Phenolsulfonic acid | 10 g/l |

The specimen was colored yellowish brown, and its surface which had been directed away from the counter electrode had a shade lighter than the other surface which had been facing the counter electrode.

What is claimed is:

1. A process for electrolytically coloring aluminum or aluminum alloy a gold color which comprises anodizing a basis metal, and electrolyzing the anodized basis metal in an acidic aqueous electrolyte by use of alternating current, said electrolyte beng prepared by adding formaldehyde in a concentration of about 3 to 50 grams per liter, and a thiosulfate in a concentration of about 0.3 to 10 grams per liter to an acid solution of stannous sulfate in a concentration of at least about 1.5 grams per liter.

2. The process as recited in claim 1, wherein said acid solution is an aqueous solution of at least one substance selected from the group consisting of sulfuric acid, phosphoric acid, sulfamic acid, tartaric acid, lactic acid, acetic acid, propionic acid, and sulfosalicylic acid.

3. The process as recited in claim 1, wherein said formaldehyde is added to the solution in the form of a substance which forms formaldehyde therein.

4. The process as recited in claim 1, wherein said substance is selected from the group consisting of formalin, trioxane, and paraformaldehyde.

5. The process as recited in claim 1, wherein said thiosulfate is selected from the group consisting of ammonium thiosulfate, sodium thiosulfate, potassium thiosulfate, and iron thiosulfate.

* * * * *